US005273251A

United States Patent [19]

Badstieber

[11] Patent Number: 5,273,251

[45] Date of Patent: Dec. 28, 1993

[54] FRAME FOR CONCRETE FORMS

[75] Inventor: Johann Badstieber, Rutesheim, Fed. Rep. of Germany

[73] Assignee: Paschal-Werk G. Maier GmbH, Steinach, Fed. Rep. of Germany

[21] Appl. No.: 716,859

[22] Filed: Jun. 18, 1991

[30] Foreign Application Priority Data

Jun. 19, 1990 [DE] Fed. Rep. of Germany ..... 4019498

[51] Int. Cl.[5] ..... E04G 9/02

[52] U.S. Cl. ..... 249/189; 52/127.5; 52/127.6; 249/210

[58] Field of Search ..... 52/127.5, 127.6; 249/2-8, 34, 189, 207, 208, 210, 219.1

[56] References Cited

U.S. PATENT DOCUMENTS

| | | | |
|---|---|---|---|
| 1,527,698 | 2/1925 | Pearthree | 249/7 |
| 1,944,511 | 1/1934 | Heltzel | 249/6 |
| 3,862,737 | 1/1975 | Fuston, Jr. | 249/189 |
| 3,967,422 | 7/1976 | Stegmeier | 249/2 |
| 4,422,617 | 12/1983 | Gallis | 249/189 |
| 4,693,445 | 9/1987 | Sprecace-Pantoli | 249/189 |
| 5,015,117 | 5/1991 | Pawlicki | 249/6 |

FOREIGN PATENT DOCUMENTS

| | | | |
|---|---|---|---|
| 3429303 | 2/1986 | Fed. Rep. of Germany | 249/189 |
| 3429304 | 7/1987 | Fed. Rep. of Germany . | |
| 3638537 | 5/1988 | Fed. Rep. of Germany | 249/189 |

*Primary Examiner*—Jay H. Woo
*Assistant Examiner*—James P. Mackey
*Attorney, Agent, or Firm*—Darby & Darby

[57] ABSTRACT

A form for use in shutterings for the pouring of concrete has a panel with a marginal portion reinforced by a hollow frame having an outer wall which is normal to the panel and a second wall remote from the panel, integral with the outer wall and having one or more sockets for reception of the working end of a crowbar serving to lift and/or otherwise displace or reorient the form. Each socket can constitute a recess or an opening in the second wall. The second wall is or can be disposed between the outer wall and an inner wall which is parallel to the outer wall and extends to the rear side of the marginal portion of the panel. The second wall can be reinforced in the region where it is engaged by the working end of the crowbar in order to reduce the likelihood of deformation of the frame, particularly of the outer wall which contacts a support, abuts a ceiling or is in abutment with the frame of an adjacent form in an assembled shuttering.

24 Claims, 1 Drawing Sheet

1
2
2b
2a
13a
13b
3b
3
3a
11b
11
11d
11a
9a'
9
9c
9b'
8b
10'
13
4
12
7
10
9b
9a
8a
6
5b
5c
5
5a 201
202
203
211
211a
209
207
202a
205c
205
205a 101
2
103b
103a
109c
111
106
107
105
109
107
107b
107a

FRAME FOR CONCRETE FORMS

BACKGROUND OF THE INVENTION

The invention relates to forms for the pouring of concrete or the like. Such forms are used to assemble so-called formworks or shutterings.

A form for use in shutterings is often quite heavy and bulky. The bulk and weight are attributable, at least in part, to the provision of frames which are adjacent the marginal portions of the panels of such forms and serve to stiffen the panels as well as to rest on a support (e.g., on the ground or on the floor) or to abut the frames of adjacent forms in an assembled framework. The frame of a form is normally hollow and includes an outer wall which extends from one side of the marginal portion of the panel and the outer side of which comes. into contact with a support or with the outer wall of the frame on a neighboring form when the forms are in actual use. As a rule, the outer wall of the frame extends at right angles to the panel.

German Pat. No. 34 29 304 to Schliephacke discloses a form wherein the outer wall of the frame is provided with an elongated recess which is remote from the panel and is intended to receive the working end of a crowbar serving to lift the form and/or to adjust the position of the form relative to the adjacent form or forms. A drawback of the patented frame is that the recess weakens that (outer) wall of the frame which takes up the major part of stresses when the form is in use. Thus, if the form is set up to rest on the outer wall of the bottom section of its normally rectangular frame, such outer wall abuts the floor or the ground and carries the entire weight of the form. Moreover, the recess in the outer wall of the frame contributes to a reduction of the overall area of the exposed outer side or surface of such outer wall. Therefore, if the outer wall is to sealingly abut the outer wall of an adjoining frame or a support, the area of sealing engagement with the adjoining frame or with the support is relatively small so that freshly poured concrete is likely to escape from the cavity which is defined by the assembled framework for reception of concrete.

A frame is normally provided on a very heavy and bulky form in order to stiffen a relatively large concrete-contacting panel. If a crowbar is used to lift a very heavy form, and the working end of the crowbar is inserted into a recess which is provided in the outer wall of the frame at a considerable distance from the marginal portion of the panel, the crowbar is likely to cause at least some deformation of the engaged outer wall (e.g., during lifting of the form off a support) as well as of that section or those sections of the same frame which are adjacent the frame(s) of the neighboring form(s). This can result in the development of clearances which permit freshly poured concrete to escape between neighboring forms. The danger of undesirable deformation of certain sections of or of an entire frame is particularly pronounced after repeated lifting and/or other shifting of a relatively heavy form by resorting to a crowbar or to an analogous tool.

Though the recess in the outer wall of the frame which is disclosed by Schliephacke contributes to convenience of insertion of the working end of a tool, its drawbacks often outweigh its advantages, especially when the form is very heavy so that its frame and its panel are likely to undergo extensive deformation when the recess receives the working end of a crowbar or a like tool. Proposals to overcome the drawbacks of the patented frame by increasing the thickness of its walls have met with little success because this contributes to the bulk, weight and cost of the form and renders the adjustment of the form in a formwork or shuttering even more difficult and time-consuming. Moreover, this necessitates the exertion of an even greater force with attendant increased danger of deforming the frame in spite of its increased bulk and strength.

OBJECTS OF THE INVENTION

An object of the invention is to provide a novel and improved form for use in formworks or shutterings which is constructed and assembled in such a way that it can be manipulated by crowbars, mortise chisels and analogous heavy duty tools without the likelihood of damage to or deformation of its frame.

Another object of the invention is to provide a novel and improved frame for use in the above outlined form.

A further object of the invention is to provide a frame which embodies novel and improved facilities for convenient and safe engagement by the working end of a crowbar or another form aligning, lifting, orienting, displacing or shifting tool.

An additional object of the invention is to provide a simple and inexpensive frame which can be used in conjunction with small, medium-sized or large panels in forms for the pouring of concrete and the like.

Still another object of the invention is to provide a frame which is more resistant to deformation than heretofore known frames and which can establish a larger-area contact with a support or with the frame or frames of one or more neighboring forms than heretofore known frames.

A further object of the invention is to provide a novel location for engagement between the working end of a crowbar or an analogous tool and the reinforcing frame for the marginal portion of the panel in a form for the pouring of concrete or the like.

Another object of the invention is to provide a frame which constitutes an improvement over and a further development of the frame described and shown in German Pat. No. 34 29 304.

An additional object of the invention is to provide a frame which need not be bulkier and/or heavier than a conventional frame but can stand more pronounced deforming and/or other stresses than presently used frames.

A further object of the invention is to provide a frame which can be applied to the panels of existing forms for the pouring of concrete or the like as a superior substitute for heretofore known and used frames.

SUMMARY OF THE INVENTION

The invention is embodied in a form of the type normally used for the pouring of concrete or other hardenable materials. The improved form includes a panel having a marginal portion, and a reinforcing frame for the marginal portion. The frame includes an outer wall which is disposed at one (rear) side of the panel and serves to contact a support (e.g., the floor or the ground) or a neighboring form. The outer wall has a first portion at the marginal portion of the panel and a second portion which is remote from the marginal portion, and the frame further comprises a second wall which is rigid with the second portion of the outer wall and has an outer side facing away from the marginal portion of the panel and having at least one socket for the working end of a crowbar or another tool which can be used to displace, locate or orient the form.

The frame is or can be hollow in order to reduce its weight and the overall weight of the form, and it is presently preferred to employ a frame having a substantially rectangular cross-sectional outline.

The outer wall of the frame is or can be substantially normal to the panel, and the second wall can be substantially normal to the outer wall. The at least one socket preferably extends toward the rear side of the panel adjacent the second portion of the outer wall, i.e., the socket does not extend into the outer wall so that the latter is not weakened as a result of the provision of one or more sockets in the frame. This is desirable and advantageous because the outer wall can be placed into large-area contact with the ground, with a floor or with an adjacent form.

The second wall can include a substantially trough-shaped section which surrounds the at least one socket but the socket is open at the outer side of the second wall to permit introduction of the working end of a tool. The trough-shaped section of the second wall can have a substantially U-shaped, V-shaped, trapezoidal, rectangular, semicircular or any other suitable cross-sectional outline which is convenient for introduction of the working end of the tool and for proper engagement by the inserted working end, e.g., to lift the form above a support.

The second wall preferably further includes a portion which is rigid with the second portion of the outer wall and is of one piece with or is welded to the substantially trough-shaped section of the second wall.

If the second wall of the frame is elongated, its outer side can be provided with a plurality of short or elongated sockets which are spaced apart from each other in the longitudinal direction of the second wall. Alternatively, the outer side of the elongated second wall can be provided with a single elongated socket which extends in the longitudinal direction of the second wall and has a length which is only slightly less than the length of the second wall.

The frame can further comprise a third or inner wall which is spaced apart from the outer wall and has a first portion at the rear side of the panel and a second portion which is remote from the panel. The second wall then extends between the second portions of the inner and outer walls. The inner wall can be substantially normal to the second wall and substantially parallel to the outer wall. The second wall preferably includes a first portion which is rigid with the second portion of the outer wall and a second portion which is rigid with the second portion of the inner wall. The afore-mentioned trough-shaped section is located between the first and second portions of the second wall. The first and second portions of the second wall have spaced apart edges which flank the at least one socket.

The thickness of the outer wall can but need not match the thickness of the inner wall and/or the thickness of the second wall. The trough-shaped section of the second wall has a sidewall which is adjacent but preferably spaced apart from the second portion of the inner wall and is engaged by the working end of a tool which is introduced into the at least one socket. The distance of the sidewall from the second portion of the inner wall can equal or exceed the thickness of the inner wall. For example, the sidewall can be substantially parallel to the inner wall and its distance from the second portion of the inner wall can be twice the thickness of the inner wall or the thickness of the sidewall.

The at least one socket can be located substantially or exactly midway between the second portions of the inner and outer walls. The depth of the at least one socket (as measured from the outer side of the second wall toward the panel) can be between approximately 30 and 55% of the distance of the inner wall from the outer wall of the frame.

The frame can comprise means for reinforcing the sidewall of the trough-shaped section of the second wall. This is often desirable and advantageous because such sidewall is engaged by the working end of a tool (such as a crowbar) which is inserted into the at least one socket, e.g., to move the form away from a neighboring form or to lift the form above a support. The reinforcing means can be disposed between the sidewall of the trough-shaped section and the second portion of the inner wall; such reinforcing means can form part of the inner wall and/or second wall (for example, of the sidewall of the trough-shaped section of the second wall) and can include one or more ribs and/or grooves and/or other types of reinforcing elements.

The width of the outer wall (as measured at right angles to the panel) can equal or exceed the width of the inner wall.

The distance of the second portion of the outer wall from the panel can equal or exceed the distance of the second portion of the inner wall from the panel.

The inner and/or the outer wall can be bevelled or rounded in the region of the second wall. Furthermore, the first and/or the second portion of the second wall can be rounded or bevelled at the trough-shaped section of the second wall.

The at least one socket can constitute an opening (e.g., a slot) in the second wall of the frame. The second wall then preferably comprises a reinforced portion which at least partially surrounds the opening.

The novel features which are considered as characteristic of the invention are set forth in particular in the appended claims. The improved form itself, however, both as to its construction and the mode of manipulating the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
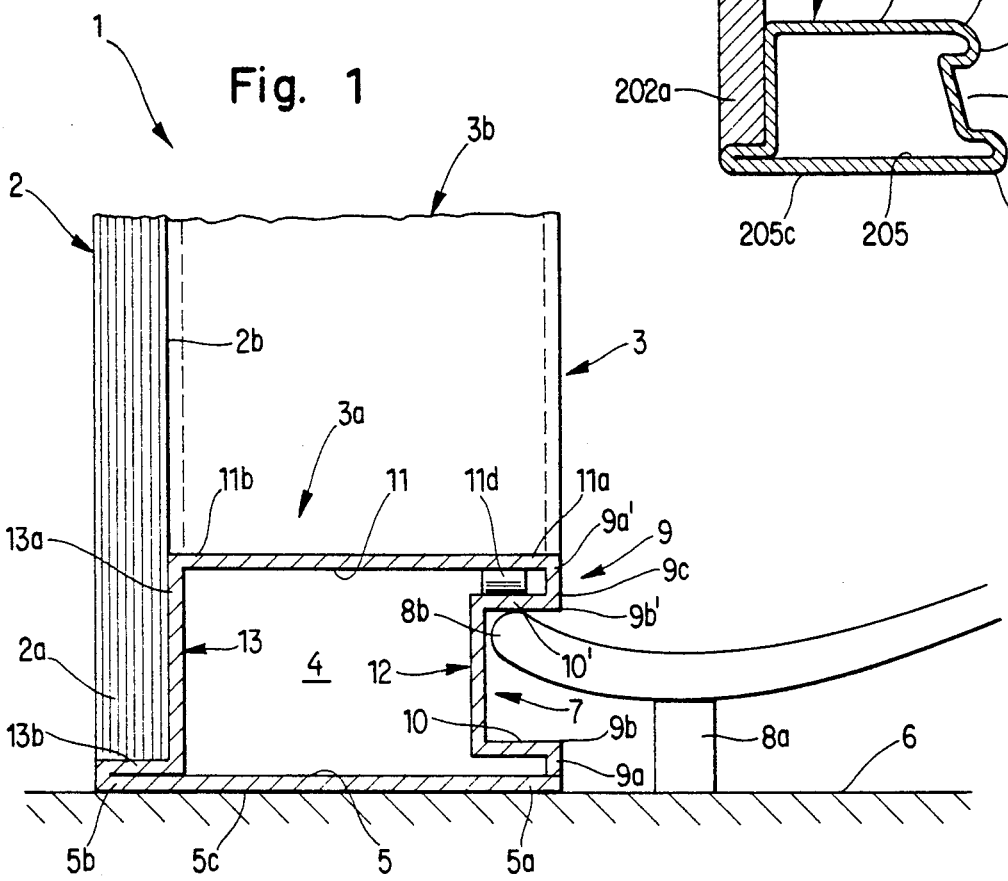
FIG. 1 is a fragmentary transverse vertical sectional view of a form with a reinforcing frame which embodies one form of the invention.

Referring first to FIG. 1, there is shown a portion of a form 1 which can be used for the assembly of formworks or shutterings for the pouring of concrete and like hardenable building or other materials. The form 1 comprises a panel 2 having a marginal portion 2*a* which is reinforced by a frame 3. FIG. 1 shows a first section 3*a* of the frame and a second section 3*b* which extends at right angles to the section 3*a* (the panel 2 is assumed to have a rectangular shape). The sections 3*a*, 3*b* are or can be integral with each other and the section 3*a* can be placed onto a support 6 (e.g., a floor or the ground) and carries the weight of the entire form 1 when the latter is set up on the support 6 to form part of a formwork at a construction site or at another location.

The construction of the section 3*b* (and of the other two sections, not shown) of the frame 3 is or can be identical with the construction of the section 3*a*; therefore, only the section 3*a* is shown and will be described in greater detail. The section 3*a* has a substantially rectangular cross-sectional outline and is hollow (note the cavity 4) to reduce its weight. This section comprises an outer wall 5 which is normal to the panel 2, a second wall 9 which is normal to the outer wall 5 and is parallel to the panel 2, and a third or inner wall 11 which is parallel, to the outer wall 5 and normal to the panel 2 and second wall 9. The width of the wall 5 (as measured at right angles to the plane of the panel 2) exceeds the width of the inner wall 11 because the outer wall 5 underlies the adjacent marginal portion 2*a* of the panel 2 (i.e., the outer wall extends all the way to that (left-hand) side of the panel 2 which faces away from the frame 3. A fourth wall 13 of the section 3*a* is parallel to the second wall 9 and is located at the adjacent rear side 2*b* of the panel 2; this fourth wall includes a portion 13*b* which overlies and is integral with the left-hand (marginal) portion 5*b* of the outer wall 5. The other (marginal) portion 5*a* of the outer wall 5 is connected to (e.g., of one piece with or welded to) the adjacent lower portion 9*a* of the second wall 9. An upper portion 9*a*, of the wall 9 is connected to (made of one piece with or welded to) the adjacent (marginal) portion 11*a* of the inner wall 11. The portion 11*b* of the inner wall is connected to the portion 13*a* of the fourth wall 13. The wall 13 can be welded, riveted or otherwise securely affixed to the marginal portion 2 of the panel 2.

It is important that the outer wall 5 have a relatively large, smooth and unobstructed outer side 5*c* because such outer side comes into contact with the top section of a frame 3 below the illustrated frame, with the upper side of the support 6, or with the upright section 3*b* of a neighboring frame 3, depending upon the orientation of the illustrated form 1 in a formwork. Large-area contact between the outer side 5*c* of the wall 5 and an adjacent surface is desirable in order to establish an adequate sealing engagement and to thus prevent the escape of poured concrete from the cavity which is defined by the illustrated form 1 with one or more additional forms. In addition, it is important to provide the outer wall 5 with a large outer side 5*c* because this ensures a reduction of stresses per unit area when the outer wall 5 is to carry the weight of the illustrated form 1 and, if necessary, the weight of one or more forms above the illustrated form. If the section 3*a* is oriented in such a way that it constitutes the top section of the frame 3, such section is often required to carry the considerable weight of a roof construction, a ceiling or the like. It is presently preferred to provide each section of the frame 3 with an outer wall which has a relatively large (i.e., relatively wide and long) outer side 5*c*. In addition, the frame 3 should be capable of withstanding pronounced deforming stresses and should be capable of providing room for engagement by the working end of a suitable tool, such as a crowbar 8 which is placed onto a fulcrum 8*a* and maintains its working end 8*b* in a socket 7 provided in the outer side 9*c* of the second wall 9. This socket is located substantially midway between the portions 5*a* and 11*a* of the walls 5, 11 and is a recess in the outer side 9*c* between the edges 9*b*, 9*b*′ of the respective portions 9*a* and 9*a*′ of the second wall 9. The illustrated socket 7 is assumed to be elongated in a direction at right angles to the plane of FIG. 1 and to extend close to the two longitudinal ends of the elongated second wall 9.

The socket 7 is surrounded by a substantially trough-shaped section 12 which constitutes the median zone of the second wall 9 between the portions 9*a* and 9*a*′. The illustrated section 12 has a substantially rectangular cross-sectional outline; however, it is equally within the purview of the invention to employ a section 12 which has a substantially V-shaped, U-shaped, trapeziform, semicircular or other suitable cross-sectional outline that is suited for reception of the working end 8*b* of the crowbar 8 or an analogous tool. The working end 8*b* can be caused to engage the underside of a sidewall 10′ which forms part of the section 12 and is adjacent and parallel to but spaced apart from the portion 11*a* of the inner wall 11. The sidewall 10′ must be sufficiently strong to be capable of supporting the entire form 1 when the crowbar 8 is tilted in a clockwise direction in order to lift the outer wall 5 off the support 6. Therefore, the space between the sidewall 10′ and the portion 11*a* of the wall 11 preferably contains one or more reinforcing devices which can be integral parts of the sidewall 10′ and/or portion 11*a* and can include one or more ribs, grooves or other suitable formations which contribute to rigidity of the sidewall 10. FIG. 1 shows one of several ribs 11*d* which are integral parts of the wall portion 11*a* and are depressed from the general plane of the portion 11*a* to abut the upper side of the sidewall 10′. The lower sidewall 10 of the trough-shaped section 12 may but need not be provided with reinforcing means to strengthen the section 12 and hence the sidewall 10′.

An important advantage of the provision of the socket 7 in the outer side 9*c* of the wall 9 is that this socket does not reduce the size of the outer side 5*c* of the wall 5 and that the working end 8*b* of the tool 8 is caused to engage the frame section 3*a* at a location which is spaced apart from the outer wall 5. This ensures that the area of the outer side 5*c* can be larger than in heretofore known frames which are provided with facilities for engagement by a lifting, reorienting or like tool and that the outer wall 5 is much less likely to undergo temporary or permanent deformation during manipulation of the respective form 1.

The frame 3 can be made of metallic sheet material and the socket 7 can be formed by appropriate shaping of the wall 9. Alternatively, and if the walls of the frame 3 are relatively thick, the socket 7 can be formed by removing some material at the outer side 9*c* of the wall 9. The wall 9 can be a separately produced part which is welded to the adjacent portions 5*a*, 11*a* of the walls 5 and 11. Alternatively, the section 12 can be a separately produced part which is welded or otherwise reliably secured to the portions 9*a*, 9*a*′ of the second wall 9.

The width of the socket 7 can be constant, i.e., such socket can be flanked by straight edges 9*b*, 9*b*′ of the portions 9*a* and 9*a*′. It is presently preferred to employ a section 12 which is of one piece with portions 9*a* and 9*a*′ of the wall 9 because this contributes to stability of the section 3*a* and of the entire frame 3. In addition, it is normally simpler to make a frame wherein the wall 5 is of one piece with the walls 9 and 13, the wall 11 is of one piece with the walls 9 and 13, and the section 12 is of one piece with the portions 9*a*, 9*a*′ of the wall 9.

Figure 2:
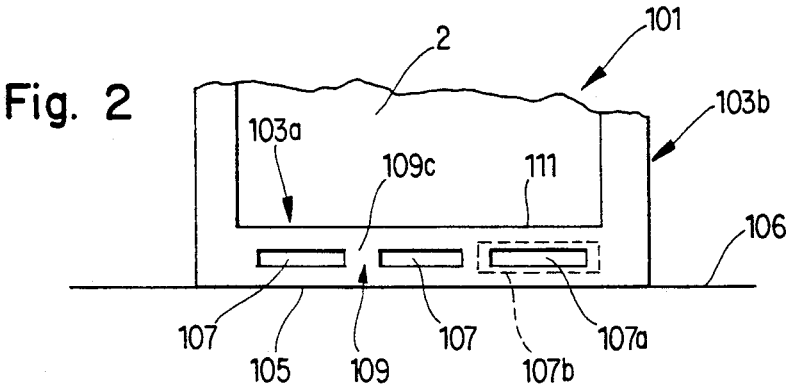
FIG. 2 is a fragmentary rear elevational view of a second form.

FIG. 2 shows that the wall 109 of a modified frame section 103*a* can be provided with a plurality of sockets 107 which are spaced apart from each other in the longitudinal direction of the wall 109. At least one of these sockets 107 (such as the socket designated by the reference character 107*a*) can constitute an opening (e.g., an elongated slot) which permits entry of the working end of a crowbar or another suitable tool. The wall 109 is preferably reinforced (at 107*b*), at least in part or all the way, around the slot-shaped socket 107*a* in order to reduce the likelihood of deformation of the wall 109, e.g., during lifting of the form 101 off a support 106. The sockets 107 which are not slots can be formed by deep drawing or by welding sections (corresponding to the section 12 of FIG. 1) behind slots in the wall 109 of FIG. 2. It is clear that the wall 109 of FIG. 2 can be provided only with sockets in the form of slots 107*a* or only with sockets 107.

Referring again to FIG. 1, the distance of the sidewall 10' from the portion 11*a* of the inner wall 11 can equal or exceed the thickness of the wall 11 or of any other wall in the frame 3. For example, such distance can equal or approximate twice the thickness of the wall 11. It has been found that the illustrated section 12 contributes to stiffness of the sidewall 10' as well as to stiffness of the sidewall 10 and of the outer wall 5 which is desirable and important for the aforediscussed reasons, namely as concerns the ability of the outer wall 5 to resist deforming stresses and to provide a large-area contact with the support 6 or with another outer wall. The reinforcement(s) 11*d* are particularly desirable and advantageous if the socket 7 (and hence the sidewall 10') is relatively long. The likelihood of deformation of the sidewall 10' can be further reduced by selecting the depth of the socket (as measured from the outer side 9*c* of the wall 9 toward the rear side 2*b* of the panel 2) in such a way that it does not exceed and can be less than half the distance of the walls 5 and 11 from each other. In the embodiment of FIG. 1, the depth of the socket 7 approximates one-third of the distance of the walls 5 and 11 from each other.

The space between the sidewall 10' and the portion 11*a* of the inner wall 11 can be filled with a deformation-resistant material to further reduce the likelihood of deformation of the sidewall 10', of the entire section 12 and particularly of the outer wall 5. Such deformation-resistant filler material can be employed in addition to or in lieu of the reinforcing rib or ribs 11*d*. Furthermore, such rib or ribs can be used together with or instead of discrete protuberances at the upper side of the sidewall 10' and/or at the underside of the wall portion 11*a*.

Figure 3:
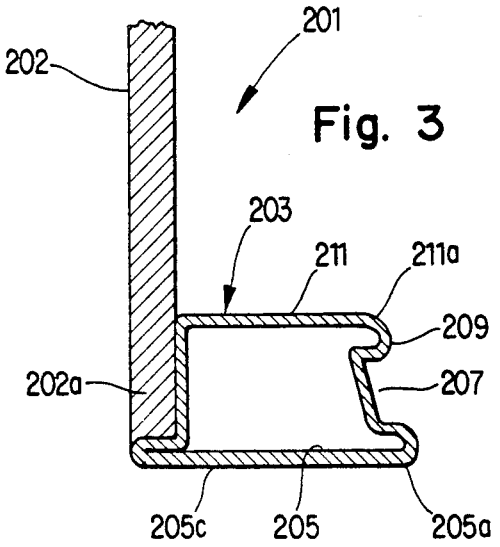
FIG. 3 is a fragmentary transverse vertical sectional view of a third form.

The frame 1 of FIG. 1 is susceptible of additional modifications without departing from the spirit of the invention. For example, and as shown in FIG. 3, the width of the outer wall 205 can exceed the width of the inner wall 211 so that the portion 205*a* of the wall 205 is more distant from the panel 202 than the portion 211*a* of the inner wall 211. This renders it possible to further enlarge the outer side 205*c* of the outer wall 205 and is possible because the socket 207 is not provided in the outer wall 205. The fact that the wall 209 of the frame 203 is not parallel to the panel 202 is of no consequence since the working end of a crowbar or an analogous tool can be readily inserted into the socket 207 of the slightly or even pronouncedly inclined wall 209. Again, the working end of the tool need not come into contact with the outer wall 205 so that the likelihood of even temporary deformation of this outer wall is very remote.

The reference characters which are used in FIGS. 2 and 3 are the same as those used in FIG. 1 plus 100 and 200, respectively.

The edge 9*b* and/or 9*b'* between the portion 9*a'* and/or 9*a'* of the wall 9 and the adjacent sidewall 10 or 10' of the trough-shaped portion 12 can be rounded or bevelled (see FIG. 3). This might be desirable and advantageous for more convenient insertion of the working end 8*b* of the tool 8 and/or for other reasons, e.g., for the sake of greater stability, to reduce the likelihood of injury and/or for convenient application of customary or specially designed clamps which are used to connect the frames 3 of neighboring forms 1 to each other. Similar bevelled or rounded transitions can be provided between the portions 11*a* and 5*a* of the walls 11 and 5 on the one hand and the adjacent portions 9*a'*, 9*a* of the wall 9 on the other hand.

The wall 9 need not be flat but can have a concave or convex outer side between the portions 5*a* and 11*a* of the walls 5 and 11. This can obviate the need for bevelling or rounding of the transitions from the outer surfaces of the portions 11*a*, 5*a* into the outer surfaces of the adjacent portions 9*a'*, 9*a*, respectively, i.e., such bevelling or rounding is a consequence of the utilization of a wall 9 having a convex outer side 9*c*.

If the socket or sockets 7, 107 and/or 207 are replaced with sockets in the form of openings (such as the socket 107*a* of FIG. 2), the reinforcing material 107*b* can be welded to the wall 109, at least in the region adjacent the wall 111 but preferably all around the respective socket 107*a*. This ensures that the wall 109 can readily stand the stresses which develop when the socket 107*a* receives the working end of a tool which is used to lift and/or otherwise displace the form 101. The reinforcement for the socket 107*a* can constitute an inwardly extending flap which is obtained by providing the wall 109 with a substantially U-shaped slit preparatory to the making of the slot-shaped socket 107*a*. Alternatively, one or more reinforcements can be riveted or separably connected to the wall 109 around a portion of or around the entire socket 107*a*.

An important advantage of the improved frame is that the area of the outer side of the outer wall need not be reduced in order to provide facilities for engagement of the frame by the working end of a lifting and/or other tool. Moreover, the magnitude of forces which are transmitted to the outer wall as a result of manipulation of the form by a crowbar or a like tool is a minute fraction of the magnitude of forces acting on the outer wall in the frame of the aforediscussed German Pat. No. 34 29 304; therefore, the outer wall of the improved frame is highly unlikely to undergo even temporary deformation which is sufficiently pronounced to affect the sealing action of the outer wall or its ability to establish a large-area contact with a support. Since the socket or sockets are provided in a wall other than the outer wall of the frame, the locus of application of a tool is always remote from the outer wall with attendant beneficial effects upon the sealing and supporting actions of the outer wall.

It is often sufficient to provide one or more sockets in only one section (such as the section 3*a* of the frame 3 in FIG. 1) of the frame, particularly if the form is to be installed in a shuttering in a particular position or orientation so that the section 3*a* is located above a support or above the other sections of the frame (e.g., to be engaged by a ceiling or a roof). The tool which engages the sidewall 10' of the trough-shaped section 12 then transmits forces primarily to the section 12 and to the inner wall 11 rather than to the outer wall 5. The substantially box-shaped hollow profile of the frame section 3a also contributes to stability of the frame section 3a and of the entire frame 3. The section 12 and the walls of the frame 3 can exhibit a certain amount of elasticity which even further reduces the likelihood of permanent deformation of the frame section 3a when the sidewall 10' is engaged by the working end of a lifting or other tool. This is desirable and advantageous because the frame 3 can be lifted and/or otherwise displaced again and again without risking permanent deformation of the outer wall 5. The pocket-like socket 7 of FIG. 1 has been found to be particularly suitable for convenient insertion of the working end of a tool before the working end begins to exert a force upon the sidewall 10' above it, i.e., at a location which is remote from the outer wall 5.

The provision of a single socket 7 which extends substantially the full length of the wall 9 is desirable and advantageous because the cost of the frame 3 can be reduced accordingly and the working end of a tool can be applied at any desired location between the ends of the wall 9. The provision of two or more longitudinally spaced apart sockets 107, 107a exhibits the advantage that the wall 109 and the entire frame 103 is stronger than a frame having one or more walls with elongated one-piece (uninterrupted) sockets therein.

The fact that the socket or sockets are not provided in the outer wall is of no consequence for convenience of application of a crowbar or an analogous tool. Thus, and as shown in FIG. 1, it might be advisable to employ an elementary fulcrum 8b which is placed between the support 6 and the under-side of the crowbar 8 in order to ensure that the working end 8b is located at an optimum level for proper engagement with the sidewall 10' of the section 12.

The aforediscussed presently preferred selection of the position of a socket 7 midway between the walls 5, 11 and the presently preferred depth of the socket (not more than half the distance of the wall 5 from the wall 11) also contribute to stability and convenience of manipulation of the frame section 3a and of the entire frame 3.

The wall 9, 109 or 209 will be provided with one or more sockets in the form of openings (e.g., elongated slots) if it is desirable and important to reduce the overall weight and cost of the frame and of the entire form. Eventual minor or even substantial deformation of the inner wall 11, 111 or 211 under the action of a crowbar or the like is of no consequence because this wall is not designed or intended to engage a support or a neighboring frame. The main purpose of the inner wall is to take up reaction forces which develop when a crowbar or an analogous tool is used to lift and/or to otherwise manipulate a form for the purpose of moving the outer wall 5, 105 or 205 to a better position relative to a support or relative to another form.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A form for the pouring of hardenable material, comprising a panel having a marginal portion; and a hollow reinforcing frame for said marginal portion, said frame including an outer wall disposed at one side of said panel and arranged to contact a support or a neighboring form, said outer wall having a first portion at said marginal portion and a second portion remote from said marginal portion, said frame further including a second wall fixed to the second portion of said outer wall and having an outer side facing away from said marginal portion, said outer side having at least one socket for the working end of a crowbar and another form-locating, displacing or orienting tool, said second wall including a substantially trough-shaped section surrounding said at least one socket and including a bottom wall between said socket and said one side of said panel.

2. The form of claim 1, wherein said frame has a substantially rectangular cross-sectional outline.

3. The form of claim 1, wherein said outer wall is substantially normal to said panel and said second wall is substantially normal to said outer wall, said at least one socket extending toward but short of said panel adjacent the second portion of said outer wall.

4. The form of claim 1, wherein said frame further includes an inner wall spaced apart from said outer wall and having a first portion at said side of said panel and a second portion remote from said panel, said second wall extending between the second portions of said outer and inner walls.

5. The form of claim 4, wherein said inner wall is substantially parallel to said outer wall, said second wall being substantially normal to said inner and outer walls.

6. The form of claim 4, wherein said second wall includes a first portion fixed to the second portion of said outer wall and a second portion fixed to the second portion of said inner wall.

7. The form of claim 6, wherein said portions of said second wall have spaced apart edges flanking said at least one socket.

8. The form of claim 4, wherein said substantially trough-shaped section surrounds said at least one socket between the second portions of said inner and outer walls, each of said outer, inner, second and bottom walls having a predetermined thickness and said section having a sidewall which is spaced apart from the second portion of said inner wall a distance at least matching said predetermined thickness.

9. The form of claim 8, wherein said sidewall is substantially parallel to said inner wall and said predetermined thickness is substantially half said distance.

10. The form of claim 4, wherein said at least one socket is located substantially midway between the second portions of said inner and outer walls.

11. The form of claim 4, wherein said inner and outer walls are disposed at a predetermined distance from each other and said at least one socket has a depth , as measured from the outer side of said second wall toward said panel which is between approximately 30 and 55% of said distance.

12. The form of claim 4, wherein said substantially trough-shaped section has a sidewall adjacent the second portion of said inner wall, and further comprising means for reinforcing said sidewall.

13. The form of claim 12, wherein said reinforcing means is disposed between said sidewall and said second portion of said inner wall.

14. The form of claim 13, wherein said reinforcing means is part of one of said sidewall, and said inner wall and includes at least one rib and/or at least one groove.

15. The form of claim 4, wherein said inner wall has a first width, as measured at right angles to said panel, and said outer wall has a second width at least matching said first width.

16. The form of claim 4, wherein the second portion of said inner wall is spaced apart from said side of said panel a first distance and the second portion of said outer wall is spaced apart from said side of said panel a second distance at least equal to said first distance.

17. The form of claim 4, wherein said second portion of at least one of said inner and outer walls is bevelled or rounded at said second wall.

18. The form of claim 4, wherein said second wall includes first and second portions which are respectively adjacent the second portions of said outer and inner walls and said substantially trough-shaped section is disposed between the first and second portions of said second wall, at least one portion of said second wall being rounded or bevelled at said section.

19. The form of claim 1, wherein said second wall includes a reinforced portion which at least partially surrounds said at least one socket.

20. The form of claim 1, wherein said at least one socket is open only at said outer side of said second wall.

21. The form of claim 20, wherein said section of said second wall has a substantially U-shaped, trapezoidal, V-shaped, rectangular or semicircular cross-sectional outline.

22. The form of claim 20, wherein said second wall further includes a portion fixed to the second portion of said outer wall and of one piece with or welded to said section.

23. The form of claim 1, wherein said second wall is elongated and said outer side thereof has a plurality of sockets which are spaced apart from each other in the longitudinal direction of said second wall.

24. The form of claim 1, wherein said second wall is elongated and said outer side thereof has a single elongated socket extending in the longitudinal direction of said second wall.

* * * * *